US008876637B2

(12) United States Patent
Atkins

(10) Patent No.: US 8,876,637 B2
(45) Date of Patent: Nov. 4, 2014

(54) BASKETBALL RETURN APPARATUS

(71) Applicant: Sylbert A. Atkins, Leesville, LA (US)

(72) Inventor: Sylbert A. Atkins, Leesville, LA (US)

( * ) Notice: Subject to any disclaimer, the term of this patent is extended or adjusted under 35 U.S.C. 154(b) by 16 days.

(21) Appl. No.: 13/676,913

(22) Filed: Nov. 14, 2012

(65) Prior Publication Data

US 2014/0135149 A1 May 15, 2014

(51) Int. Cl.
*A63B 69/00* (2006.01)

(52) U.S. Cl.
CPC ..... *A63B 69/0071* (2013.01)
USPC ..... 473/433; 273/397

(58) Field of Classification Search
CPC ..... A63B 2063/001; A63B 68/083; A63B 69/0071
USPC ..... 273/394–397; 473/431–435
See application file for complete search history.

(56) References Cited

U.S. PATENT DOCUMENTS

| | | | | |
|---|---|---|---|---|
| 4,714,248 | A | 12/1987 | Koss | |
| 4,786,371 | A * | 11/1988 | Postol | 473/433 |
| 4,896,882 | A | 1/1990 | Coleman | |
| 5,129,648 | A | 7/1992 | Sweeney et al. | |
| 5,246,225 | A * | 9/1993 | Matherne et al. | 273/375 |
| 5,312,099 | A * | 5/1994 | Oliver, Sr. | 473/433 |
| 5,333,853 | A * | 8/1994 | Hektor | 473/433 |
| 5,746,668 | A * | 5/1998 | Ochs | 473/433 |
| 6,267,696 | B1 * | 7/2001 | Mabe et al. | 473/433 |
| 6,458,049 | B2 | 10/2002 | Bush | |
| 6,595,877 | B2 | 7/2003 | Pearson | |
| 6,929,569 | B1 * | 8/2005 | Wang | 473/433 |
| 7,530,909 | B2 | 5/2009 | Thomas et al. | |
| 2004/0058756 | A1 * | 3/2004 | Huang | 473/433 |
| 2006/0040770 | A1 * | 2/2006 | Chou | 473/433 |
| 2007/0037638 | A1 * | 2/2007 | Rumfola, III | 473/433 |
| 2007/0042842 | A1 * | 2/2007 | Thomas | 473/433 |
| 2010/0248866 | A1 * | 9/2010 | Johnson et al. | 473/433 |

* cited by examiner

*Primary Examiner* — Mark Graham
(74) *Attorney, Agent, or Firm* — Dale J. Ream

(57) ABSTRACT

A basketball return apparatus for use with a basketball goal assembly having a backboard attached to a post with a frame member in elevation above a ground surface and a rim coupled to the backboard includes a net member having upper and lower ends. A mounting assembly includes a first end coupled to the net member upper end and a second end configured to couple the net member to the frame member of the basketball goal assembly. A support member is pivotally coupled to the net member second end, the support member movable between a retracted configuration generally adjacent and parallel to the net member and an extended configuration extending away from the second end of the net member. The support assembly may include a swivel member configured so that the net member and support member may be rotated side to side relative to the basketball goal assembly.

7 Claims, 7 Drawing Sheets

BASKETBALL RETURN APPARATUS

BACKGROUND OF THE INVENTION

This invention relates generally to basketball return net assemblies and, more particularly, to a basketball return apparatus that remains attached to a basketball backboard frame in a storage configuration and when extended in a use configuration.

Free throws are a basketball shot best practiced in a methodical and repetitive manner so that the exact same stroke may be replicated every time. In team practice settings, the shooter stays on the free throw line while team mates rebound and repeatedly return the ball to the shooter. However, when a shooter is practicing at home, such as with a basketball goal in the driveway or backyard, he often has no one to repeatedly return the ball to his desired position.

Various devices have been proposed in the art for using net assemblies to return a basketball to a shooter. Although assembly effective for their intended use, the existing assemblies must be completely detached from the backboard if regular basketball play is desired. In addition, existing proposals do not efficiently enable a user to cause redirection to multiple points on the court from which shots are being practiced.

Therefore, it would be desirable to have a basketball return apparatus that mounts to a backboard framework and may remain attached thereto in both a use and storage configuration. Further, it would be desirable to have a basketball return apparatus that includes a support assembly that holds a return net off the ground and which pivots out of the way at the storage configuration. In addition, it would be desirable to have a basketball return apparatus that swivels to direct a basketball in any direction desired by the shooter.

SUMMARY OF THE INVENTION

The present invention includes a basketball return apparatus for use with a basketball goal assembly having a backboard attached to a post with a frame member in elevation above a ground surface and a rim coupled to the backboard. The apparatus includes a net member having opposed upper and lower ends. A mounting assembly includes a first end coupled to the net member upper end and a second end configured to selectively couple the net member to the frame member of the basketball goal assembly. A support member is pivotally coupled to the second end of the net member, the support member movable between a retracted configuration generally adjacent and parallel to the net member and an extended configuration extending away from the second end of the net member. The support assembly may include a swivel member configured so that the net member and support member may be rotated side to side relative to the basketball goal assembly.

Therefore, a general object of this invention is to provide a basketball return apparatus that returns a basketball to a predetermined location on a basketball court after a made shot.

Another object of this invention is to provide a basketball return apparatus, as aforesaid, that remains coupled to a backboard framework in both storage and use configurations.

Still another object of this invention is to provide a basketball return apparatus, as aforesaid, having a net member that directs a basketball from beneath a basketball goal to a position adjacent where the shooter shot the ball from.

Yet another object of this invention is to provide a basketball return apparatus, as aforesaid, that includes a support member that raises a lower end of the net member to a height where a user can conveniently grasp the ball and shoot it again.

A further object of this invention is to provide a basketball return apparatus, as aforesaid, that includes a swivel mounting structure so that ball return direction may be set as desired by a shooter.

A still further object of this invention is to provide a basketball return apparatus, as aforesaid, that is easy to use and economical to produce.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
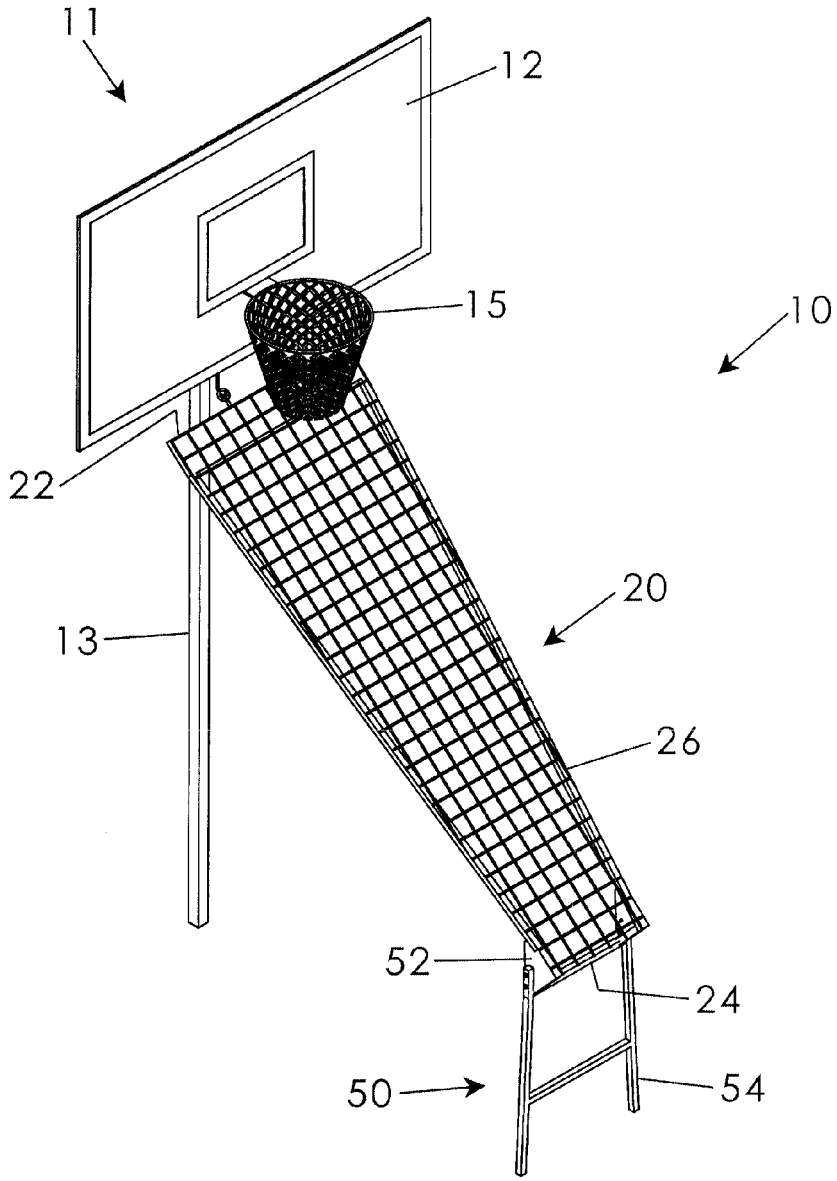
FIG. 1 is a perspective view of a basketball return apparatus according to a preferred embodiment of the present invention.

A basketball return apparatus according to a preferred embodiment of the present invention will now be described with reference to FIGS. 1 to 7 of the accompanying drawings. The basketball return apparatus 10 includes a net member 20, mounting assembly 30, and a support member 50 as will be described in detail below.

The present invention is for use with a basketball goal assembly 11 such as an outdoor basketball goal used by many people for practice and recreation. The basketball goal assembly 11 may include a backboard 12 mounted to a vertical post 13 with a frame member 14. The basketball goal assembly 11 may also include a rim 15, also referred to as a goal extending forwardly from the backboard 12. The backboard 12 is traditionally elevated above a ground surface, such as at 10 feet.

The net member 20 includes an upper end 22 and a lower end 24. The net member 20 is constructed of a mesh or other netting material such that it does not accumulate rain water, leaves, or other debris. The netting extends between the upper 22 and lower 24 ends and preferably includes side edges 26 extending therebetween. Preferably, the net member 20 includes a width at the upper end 22 that is larger/wider than a width at the lower end 24 (FIG. 1). The net member 20 is wider at its upper end 22 so as to more consistently collect a basketball falling through the rim 15 and onto the net member 20 as will be further described later.

Figure 2:
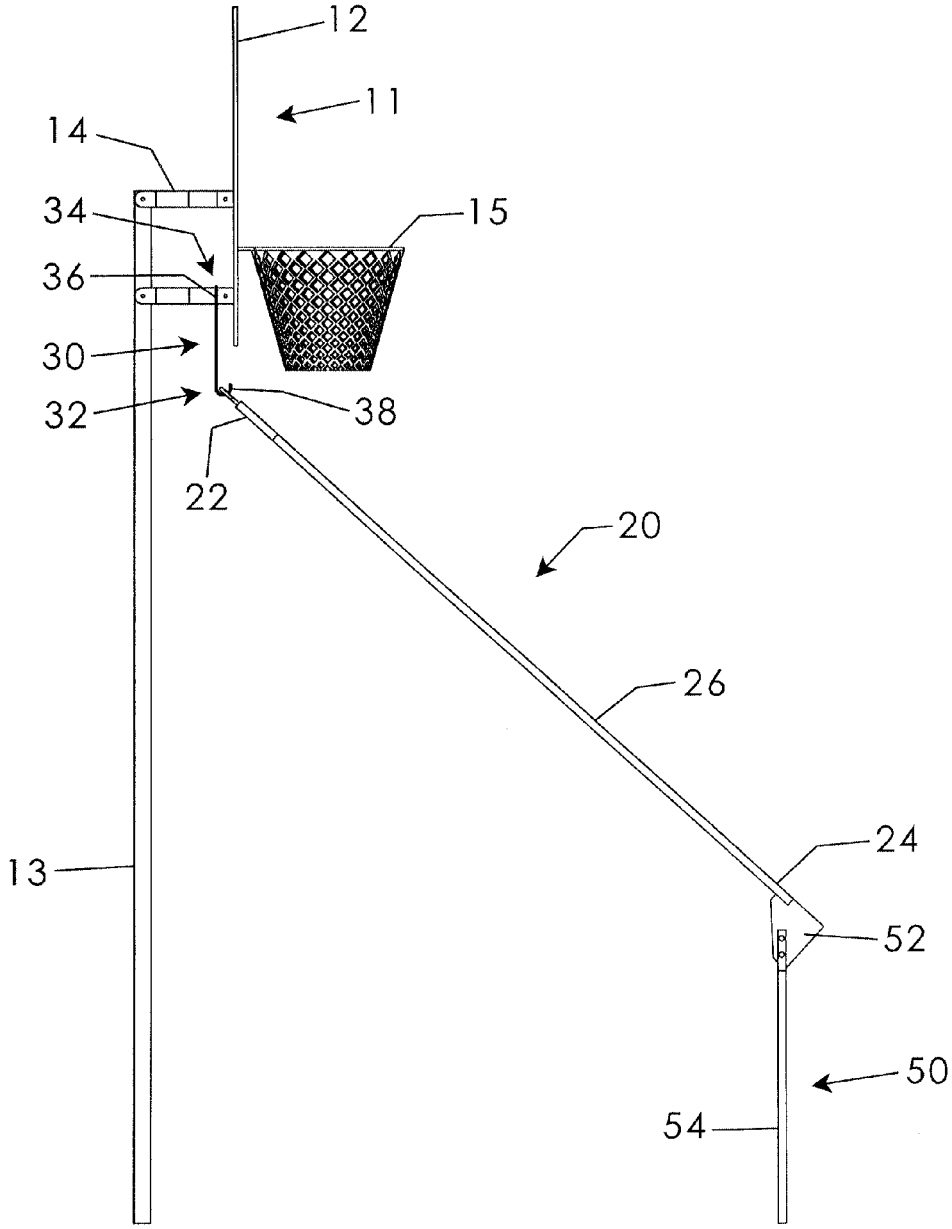
FIG. 2 is a side view of the basketball return apparatus as in FIG. 1.

The mounting assembly 30 includes a first end 32 coupled to the upper end 22 of the net member 20 and a second end 34 configured to be operatively coupled to the frame member 14 of a basketball goal assembly 11. As shown in FIG. 1, the upper end 22 of the net member 20 is situated directly beneath the rim 15 of the basketball goal assembly 11 when the first end 32 of the mounting assembly 30 is coupled to the frame member 14 of the basketball goal assembly 11. As shown in FIG. 2, the mounting assembly 30 may be a strap having an upper hook-shaped end 36 configured to selectively attach to the frame member 14 of the basketball goal assembly 11. The strap may also include a lower hook-shaped end 38 configured to selectively attach to the upper end 22 of the net member 20.

Figure 3:
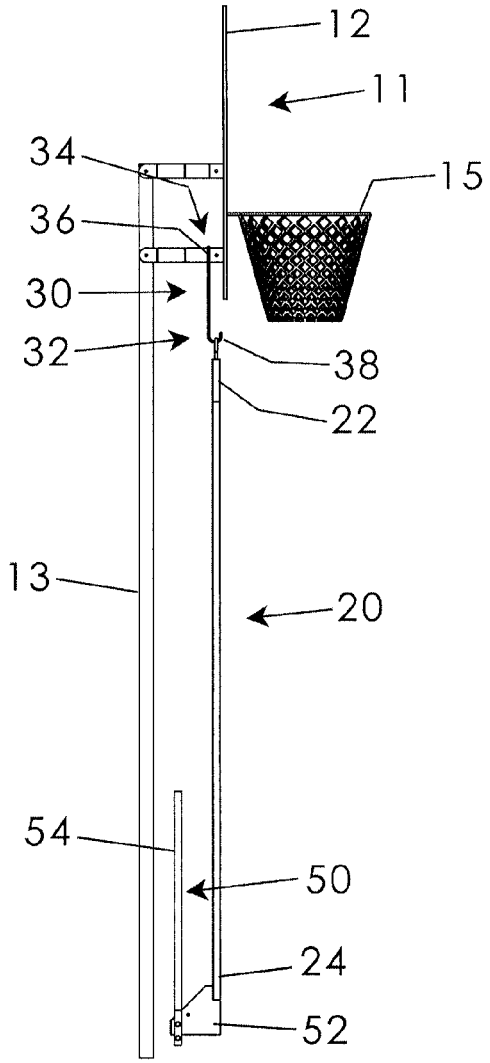
FIG. 3 is a side view of the basketball return apparatus with the support assembly in a retracted configuration.
Figure 4:
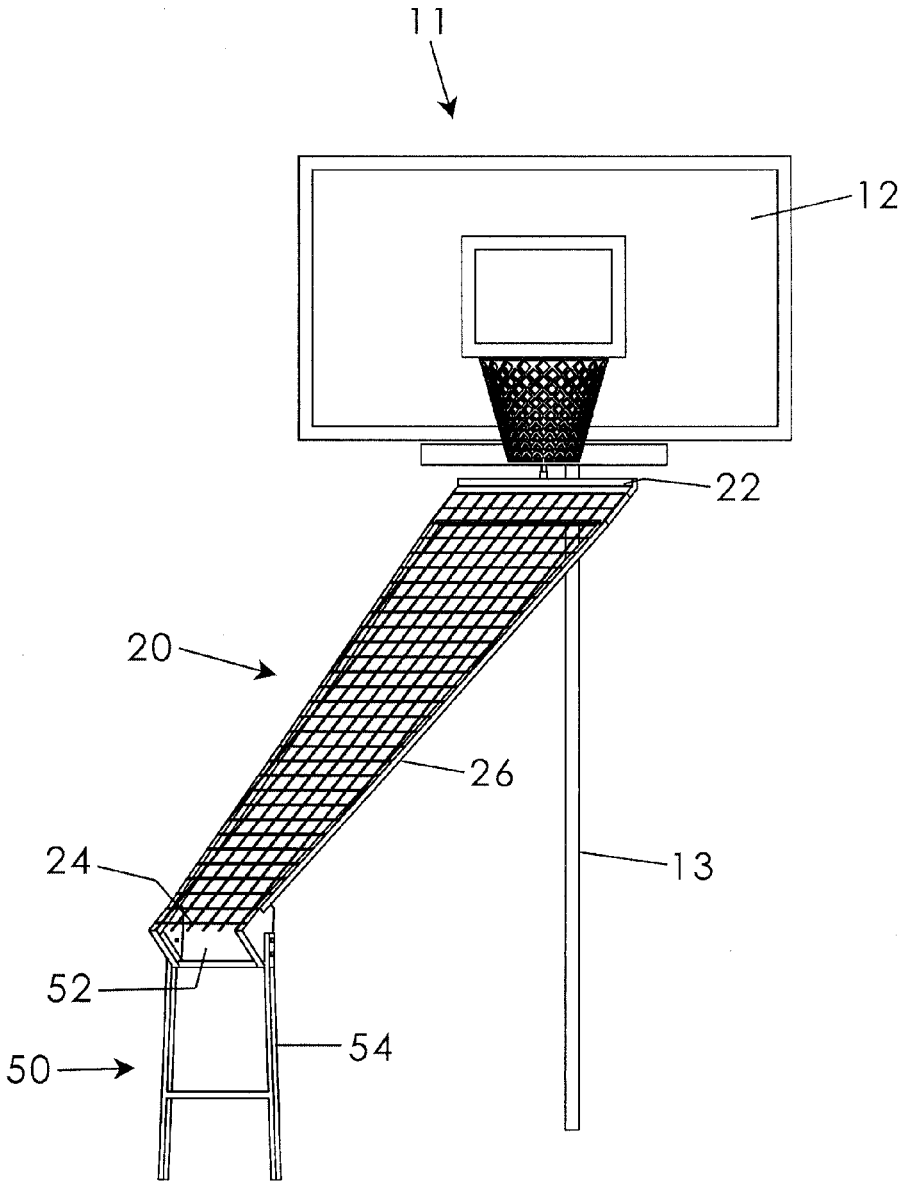
FIG. 4 is a perspective view of the basketball return apparatus showing the support assembly in a different position relative to the basketball goal.

The support member 50 may be pivotally coupled to the lower end 24 of the net member 20 so as to support the net member 20 off the ground. It is also important for the net member lower end 24 to be maintained at about waist level of a user so that a basketball being retrieved and rolling down the net member 20 is easily gathered by a user in a standing position. More particularly, the support member 50 may include a base plate 52 fixedly attached to side edges 26 of the net member 20 and adjacent the lower end 24 thereof (FIG. 4). The support member 50 includes a pair of legs 54 pivotally coupled to the base plate 52. The base plate 52 may also be referred to as a hinge plate. The legs are laterally spaced apart from one another so as to provide a stable support of the net member 20. The legs 54 may be selectively pivoted between a retracted configuration generally adjacent and parallel to the net member 20 (FIG. 3) and an extended configuration extending away from the net member lower end 24 (FIG. 2). When the support member 50 is at the retracted configuration, the net member 20 is not supported but rather just hangs from the mounting assembly 30 and basketball assembly frame member 14 (FIG. 3). It should be appreciated that the retracted configuration keeps the entire basketball return apparatus 10 out of the way of regular use of a basketball court without first requiring the apparatus 10 to be disengaged from the basketball goal assembly 11.

Figure 5A:
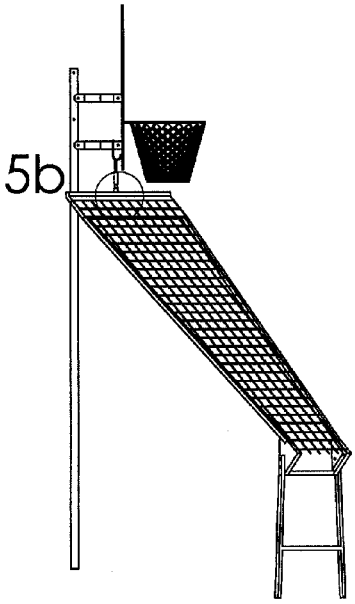
FIG. 5*a* is a side view of the basketball return apparatus as in FIG. 4.
Figure 5B:
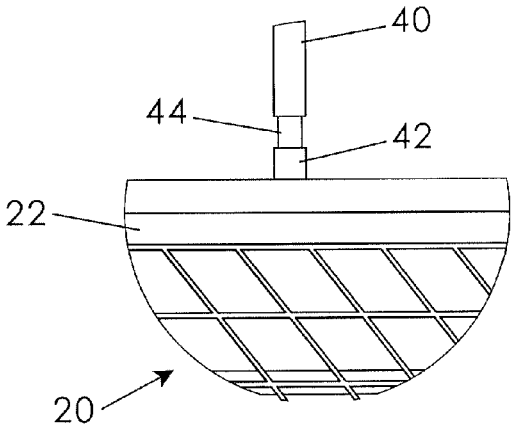
FIG. 5*b* is an isolated view on an enlarged scale taken from FIG. 5*a;*
Figure 6A:
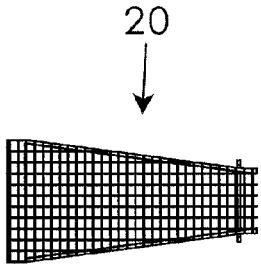
FIG. 6*a* is a top view of the basketball return apparatus removed from a basketball goal assembly.
Figure 6B:
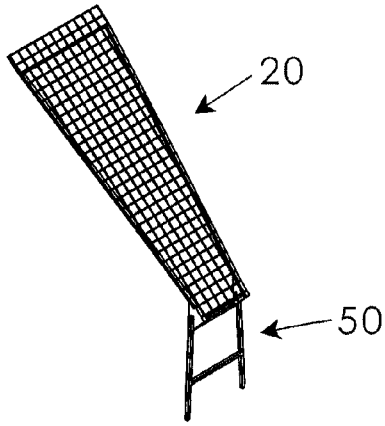
FIG. 6*b* is a perspective view of the basketball return apparatus as in FIG. 6*a;*
Figure 6C:
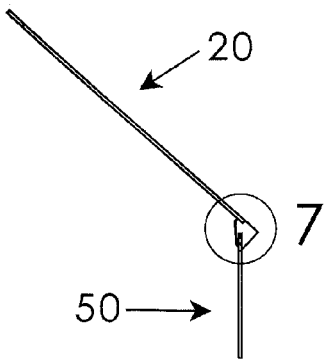
FIG. 6*c* is a side view of the basketball return apparatus as in FIG. 6*a;*
Figure 6D:
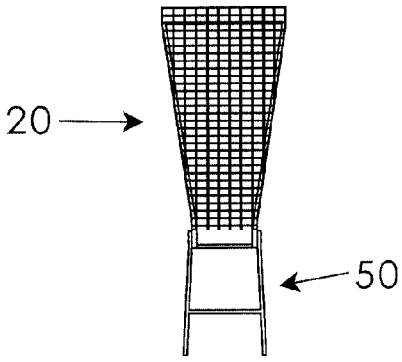
FIG. 6*d* is a front view of the basketball return apparatus as in FIG. 6*b*.
Figure 7:
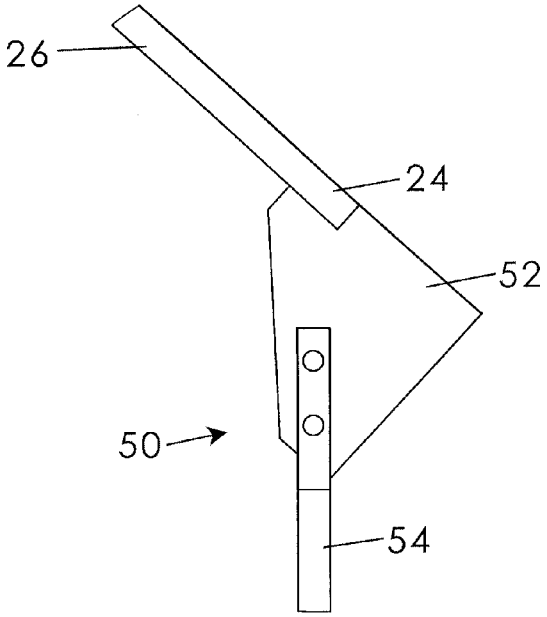
FIG. 7 is an isolated view on an enlarged scale taken from FIG. 6*c*.

In one embodiment, the mounting assembly 30 may include a swivel structure so that the net member 20 may be angled away from the backboard (FIG. 4) and not just extended straight forward (FIG. 1). More particularly, the mounting assembly 30 may include an upper support portion 40 that is operatively coupled to the basketball goal assembly 11 (FIG. 5*b*). It is understood that the upper support portion 40 may be coupled to the strap described above or directly to the frame member 14 of the basketball goal assembly 11. The mounting assembly 30 may also include a swivel member 42 that is rotatably coupled to the upper support portion 40, such as with a pin 44. The swivel member 42 may be a bearing that is free to rotate internally as the net member 20 is moved side to side relative to the backboard 12. Described another way, the upper support portion 40 defines an imaginary vertical axis about which the net member 20 is swiveled or rotated as its position on the basketball court is changed.

In use, the basketball return apparatus 10 is stored with the support member 50 in the retracted configuration as shown in FIG. 3. To use the apparatus 10, the legs 54 of the support member 50 are pivoted to the extended configuration and set up at a desired position relative to the basketball goal assembly 11 (FIG. 1). When a basketball is shot through the rim/goal, it falls through the rim 15 and onto the net member 20 adjacent the upper end 22 thereof and then rolls toward the lower end 24 where it may be retrieved by a user. In an embodiment having a swivel structure in the mounting assembly 30, the support member 50 may be moved to the left or right relative to the rim 15 (FIG. 4).

It is understood that while certain forms of this invention have been illustrated and described, it is not limited thereto except insofar as such limitations are included in the following claims and allowable functional equivalents thereof.

The invention claimed is:

1. A basketball return apparatus for use with a basketball goal assembly having a backboard attached to a post with a frame member in elevation above a ground surface and a rim coupled to the backboard, said basketball return apparatus, comprising:

a net member having an upper end and a lower end opposite said upper end;

a mounting assembly having a first end coupled to said net member upper end and a second end configured to selectively couple said net member to the frame member of the basketball goal assembly;

a support member pivotally coupled to said second end of said net member, wherein said support member includes:

a base plate coupled to said lower end of said net member;

a pair of legs pivotally coupled to said base plate and selectively movable between a retracted configuration generally adjacent and parallel to said net member and an extended configuration extending away from said lower end of said net member;

wherein said mounting assembly includes a strap having an upper hook member configured to selectively attach to the frame member of the basketball goal assembly and a lower hook member configured to selectively attach to said upper end of said net member;

wherein said net member hangs from the frame member of the basketball goal assembly in a stowed configuration out of the way of normal game play when said pair of legs is at said retracted configuration;

wherein said mounting assembly includes:

an upper support portion operatively connected to the basketball goal assembly; and a swivel member rotatably coupled to said upper portion of said mounting assembly configured such that said net member is selectively swiveled relative to the rim of the basketball goal assembly.

2. The basketball return apparatus as in claim 1, wherein said pair of legs of said support members are laterally spaced apart.

3. The basketball return apparatus as in claim 1, wherein said upper end of said net member has a width greater than a width of said lower end of said net member.

4. The basketball return apparatus as in claim 3, wherein said upper end of said net member is situated immediately beneath the rim of the basketball goal assembly when said first end of said mounting assembly is coupled to the frame member of the basketball goal assembly.

5. The basketball return apparatus as in claim 1, wherein said net member is constructed of a mesh material.

6. The basketball return apparatus as in claim 1, wherein:

said upper support portion defines an imaginary vertical axis; and said net member is selectively swiveled about said vertical axis such that said support member is selectively positioned to the front or side of the basketball goal assembly.

7. The basketball return apparatus as in claim 6, wherein said swivel member is a bearing, wherein said bearing is coupled to said upper support portion with a pin.

* * * * *